US007921614B2

(12) United States Patent
Fortin et al.

(10) Patent No.: US 7,921,614 B2
(45) Date of Patent: Apr. 12, 2011

(54) FIRE-RATED LIGHT KIT

(75) Inventors: Andre Fortin, Canton de Hatley (CA); Robert G. Dimke, Ham Lake, MN (US)

(73) Assignee: Lexington Manufacturing, Inc., Minneapolis, MN (US)

( * ) Notice: Subject to any disclaimer, the term of this patent is extended or adjusted under 35 U.S.C. 154(b) by 461 days.

(21) Appl. No.: 12/033,190

(22) Filed: Feb. 19, 2008

(65) Prior Publication Data

US 2009/0205271 A1 Aug. 20, 2009

(51) Int. Cl.
*E06B 3/988* (2006.01)

(52) U.S. Cl. ..... 52/204.71; 52/204.62; 52/204.7; 52/232

(58) Field of Classification Search ..... 52/204.71, 52/215, 208, 204.62, 204.67, 204.72, 211, 52/204.55, 204.7, 1, 232, 205, 171.1
See application file for complete search history.

(56) References Cited

U.S. PATENT DOCUMENTS

| | | | | |
|---|---|---|---|---|
| 998,620 | A * | 7/1911 | Leonard | 52/204.595 |
| 1,852,757 | A * | 4/1932 | Richard | 52/204.591 |
| 3,783,567 | A | 1/1974 | Ollis | |
| 4,178,728 | A | 12/1979 | Ortmanns et al. | |
| 4,424,653 | A | 1/1984 | Heinen | |
| 4,583,342 | A * | 4/1986 | Lier | 52/714 |
| 4,603,524 | A | 8/1986 | Mann | |
| 4,637,182 | A | 1/1987 | Ellsworth et al. | |
| 4,930,276 | A | 6/1990 | Bawa et al. | |
| 5,205,099 | A | 4/1993 | Grünhage et al. | |
| 5,355,625 | A | 10/1994 | Matsuoka | |
| 6,327,826 | B1 | 12/2001 | Mann | |
| 6,381,915 | B1 | 5/2002 | Wood | |
| 6,408,578 | B1 | 6/2002 | Tanaka et al. | |
| 7,059,092 | B2 | 6/2006 | Harkins et al. | |
| 7,487,591 | B2 * | 2/2009 | Harkins et al. | 29/897.312 |

FOREIGN PATENT DOCUMENTS

| | | | |
|---|---|---|---|
| EP | 0 473 304 | A2 | 3/1992 |
| GB | 2 155 982 | A | 10/1985 |
| GB | 2 287 739 | A | 9/1995 |
| GB | 2 340 166 | A | 2/2000 |
| GB | 2 352 468 | A | 1/2001 |
| GB | 2 394 246 | B | 7/2006 |
| JP | 1997227176 | A | 9/1997 |
| WO | WO 2006/037940 | A1 | 4/2006 |

OTHER PUBLICATIONS

Envirograf Fire Prevention Products, dated Jul. 10, 2007, http://www.envirograf.com/products, pp. 1-8.
Steel Door Institute, Technical Data Series, Basic Fire Door Requirements, 2001, pp. 1-9.

* cited by examiner

*Primary Examiner* — Basil Katcheves
*Assistant Examiner* — Branon C Painter
(74) *Attorney, Agent, or Firm* — Merchant & Gould P.C.

(57) ABSTRACT

A fire-rated light kit for a fire-resistant partition includes a track for holding a window pane in an aperture of the partition. The track includes a channel for capturing an edge of the window pane, and a flange. A first intumescent material is positioned under the track to seal between the track and the partition. A second intumescent layer is positioned on top of the track. A flammable molding material can be positioned over the flange of the track. In the event of heat or flame, the second intumescent layer expands and pushes the flammable trim away from the glass and/or partition.

13 Claims, 10 Drawing Sheets

FIRE-RATED LIGHT KIT

FIELD OF THE INVENTION

The present invention relates to light kits and other constructions for use in doors, closures, walls and partitions where flammable materials are used adjacent to a window or other opening.

BACKGROUND OF THE INVENTION

Fire-rated doors, or "fire doors", are used in buildings as passive fire protection devices to prevent the spread of fire, yet allow people to pass through fire-rated walls of the buildings. Doors, closures, walls and other partitions must all meet various burn tests and fire standards in building construction. Adding a window or other opening in the door, closure, wall or partition is common. Often the opening includes trim or molding around the glass or other element positioned in the opening.

Using flammable trim materials around windows and openings may be detrimental to the fire rating of the door, closure, wall or other partition. During a fire, the flammable trim may burn causing the door or other structure to fail at the window area. Therefore, it is common for fire-resistant trim to be used. Flammable trim, such as real wood, has been identified as many times being more aesthetically pleasing than fire-resistant alternatives. In the case of a fire-rated door, the fire-resistant interior construction of the door may include a wood veneer exterior. Using fire-resistant, non-wood trim around a window next to the wood veneer of the door may lead to a less desirable look for the finished structure.

There is a desire to allow flammable trim, such as wood, to be used and still meet various fire ratings associated with the door, closure, wall or other partition in a fire-rated light kit.

SUMMARY OF THE INVENTION

The present invention relates to a fire-rated light kit including a window track defining a channel for capturing an edge of a window pane and a flange. A first intumescent material is positioned on a top of the track. A second intumescent material is positioned under the track. The track is positioned along a fire resistant partition including an internal edge defining an aperture. The first intumescent material expands in response to heat or flame to cause a trim member to be pushed away from the partition and window. The second intumescent material expands in response to heat or flame by sealing between the track and the partition.

DETAILED DESCRIPTION OF THE PREFERRED EMBODIMENTS

Figure 1:
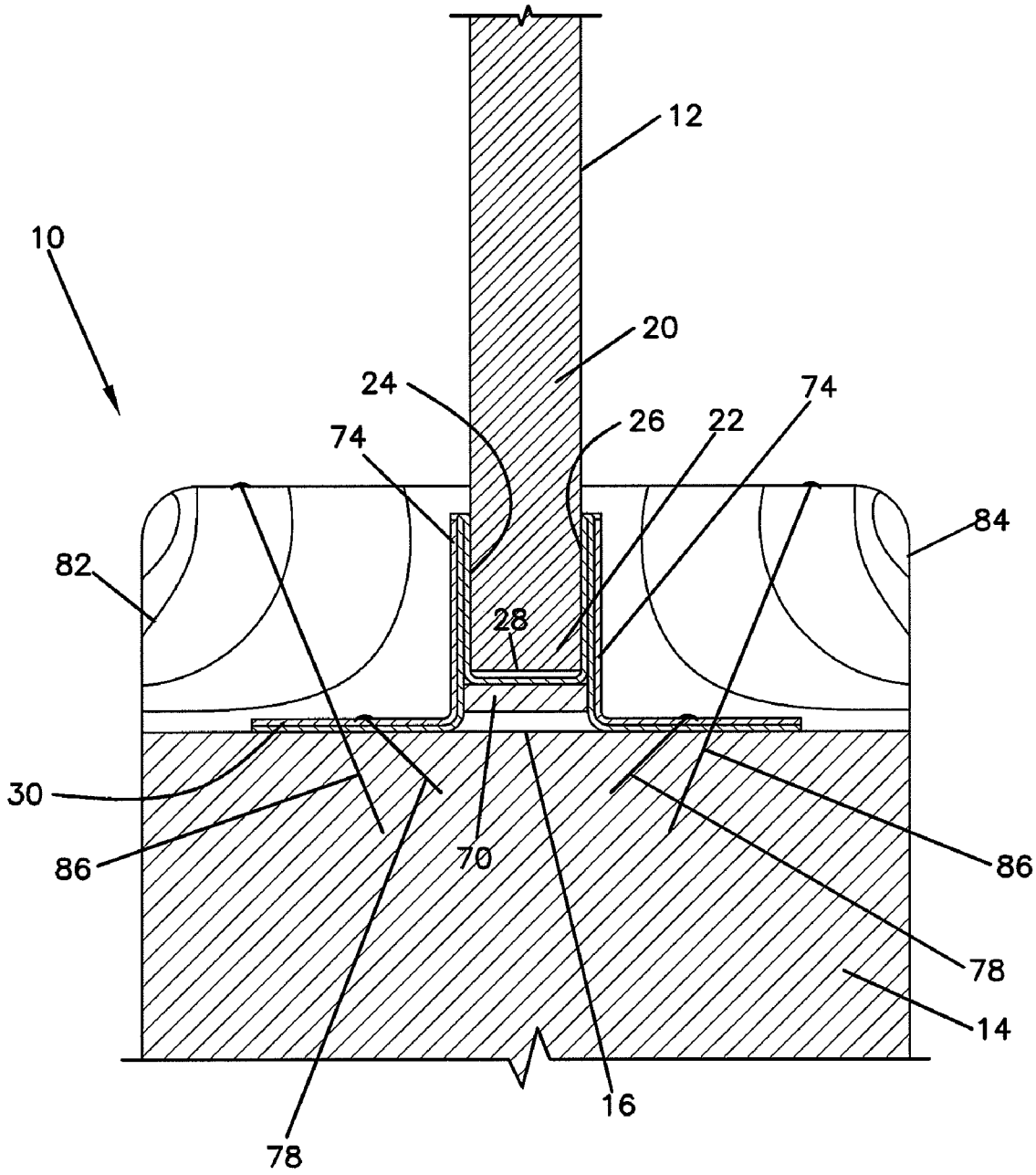
FIG. 1 is a cross-sectional view of a portion of a partition including a window, trim, and a track in accordance with the present invention.
Figure 2:
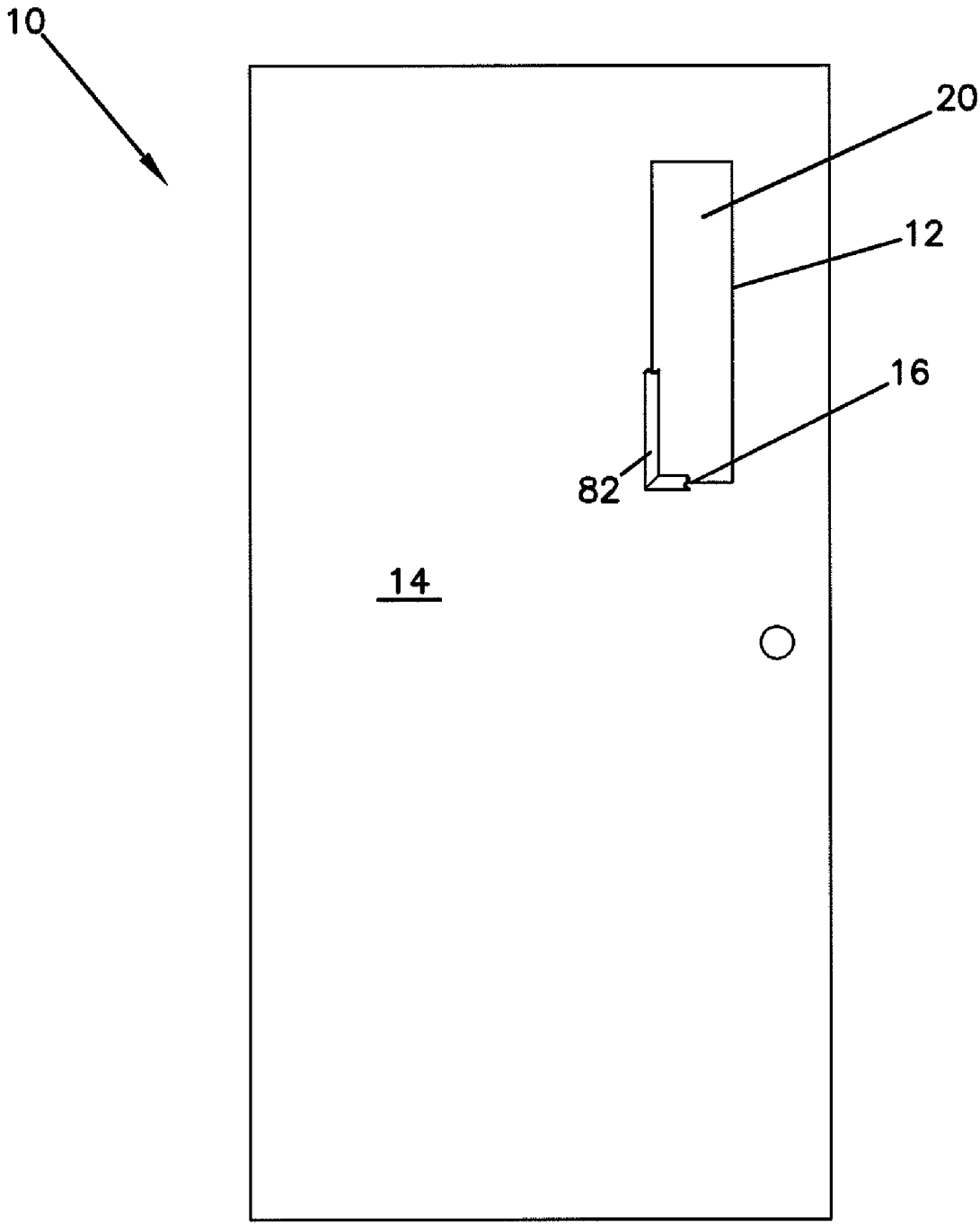
FIG. 2 is a front elevation of the partition of FIG. 1 including a window in accordance with the present invention.

Referring now to FIGS. 1 and 2, a door 10 includes a window 12. Door 10 is a fire-rated structure, meaning that door 10 meets certain fire ratings depending on its construction. The fire ratings can vary depending on the door construction. Ratings can be based on a certain number of minutes in industry-defined flame tests, such as 45, 60 or 90 minutes. In general, the door material 14 comprising the main body of door 10 is made from fire-resistant material. A flammable veneer may be used on an exterior surface of door 10. Such veneer quickly burns away in a fire, and does not significantly affect the fire-rating of the door.

The present invention relates to using fire-rated light kits including flammable trim pieces 82, 84 around the window 12. While the illustrated embodiments including the fire-rated light kits are doors, other building structures such as closures, walls or partitions can be provided instead. Side panels (side lights) next to a door, or a transom above the door are other examples. Window 12 can be any structure positioned within the door or other wall structure.

Opening 16 for window 12 in door 10 includes a perimeter edge 18. Glass or other window material 20 is positioned in opening 16. Glass or glass pane 20 includes a periphery 22. A track 30 captures periphery 22 of glass 20. As shown in FIG. 1, periphery 22 of glass 20 includes a first side edge portion 24, a second side edge portion 26, and an outside edge surface 28. Track 30 is shown as being linear in the shape of the edges of the periphery 22 of glass 20. A segment of track 30 is positioned along each of the bottom, the sides and the top of the glass.

Figure 3:
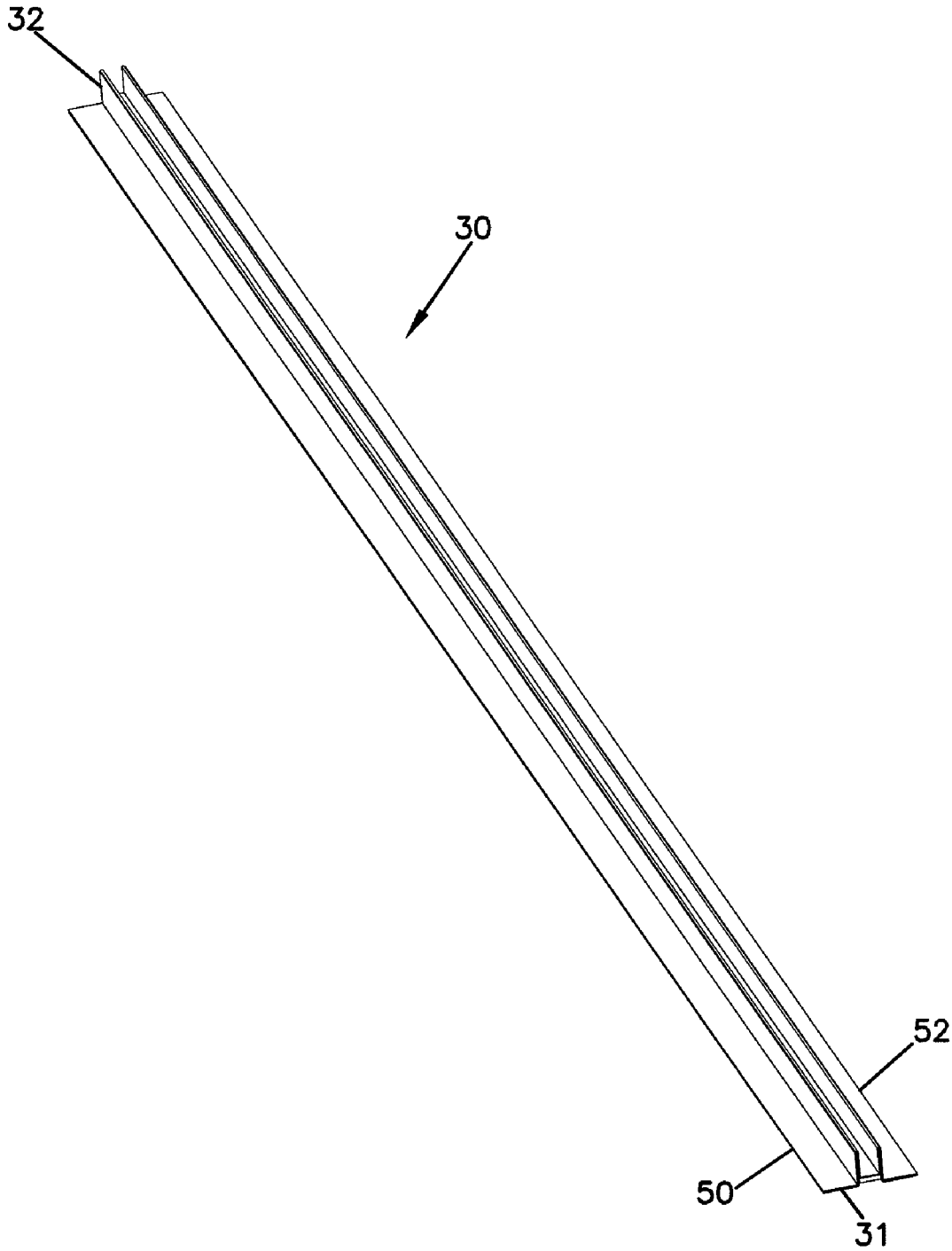
FIG. 3 is a perspective view of one embodiment of a segment of track in accordance with the present invention.
Figure 4:
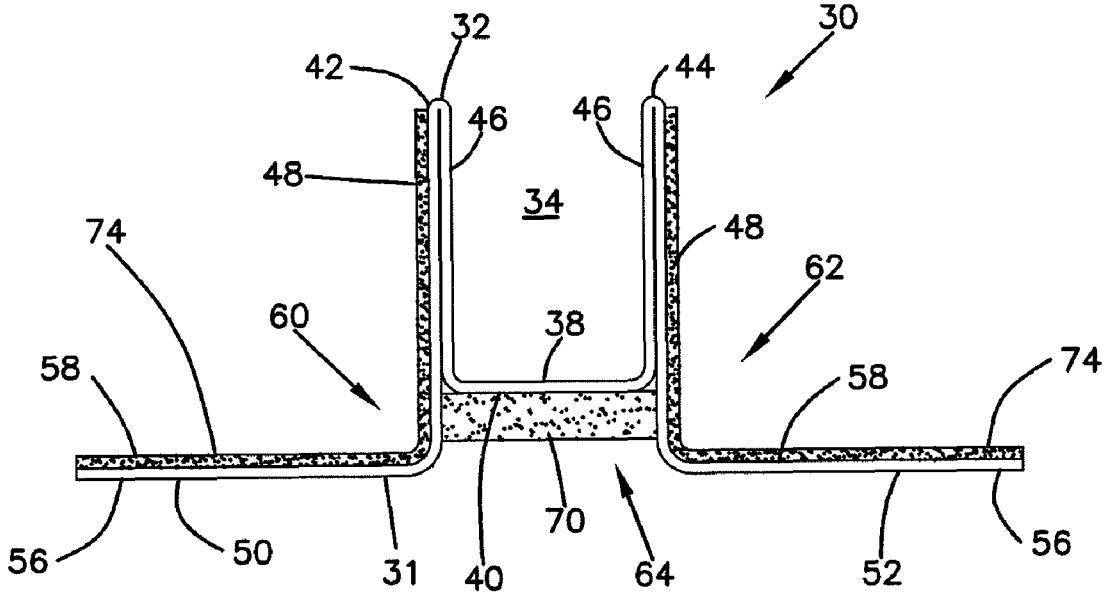
FIG. 4 is an end view of the track of FIG. 3.

Referring also now to FIGS. 3 and 4, track 30 includes a body 31 including a central channel section 32 defining a U-shaped pocket 34. Track 30 shown in the figures is oriented to hold the lower edge of glass 20. Central channel section 32 of track 30 includes a base 38 with a lower surface 40. Central channel section 32 includes a first projecting side or member 42, and a second projecting side or member 44. Each projecting member 42, 44 includes an inner surface 46 and an outer surface 48.

Track 30 further includes a first flange 50 and a second flange 52 which extend outwardly in opposite directions. Each flange includes a base surface 56, and an opposite facing surface 58. Track 30 defines upper outside corners 60, 62. Track 30 further defines a lower pocket 64. Track body 31 is made from metal or other fire-resistant material. In one form, track body 31 is made from bent sheet metal, where projecting members 42, 44 are made from bent over portions of the sheet metal. Track 30 can be cut into segments or bent into segments so as to surround the periphery 22 of glass 20.

Figure 3A:
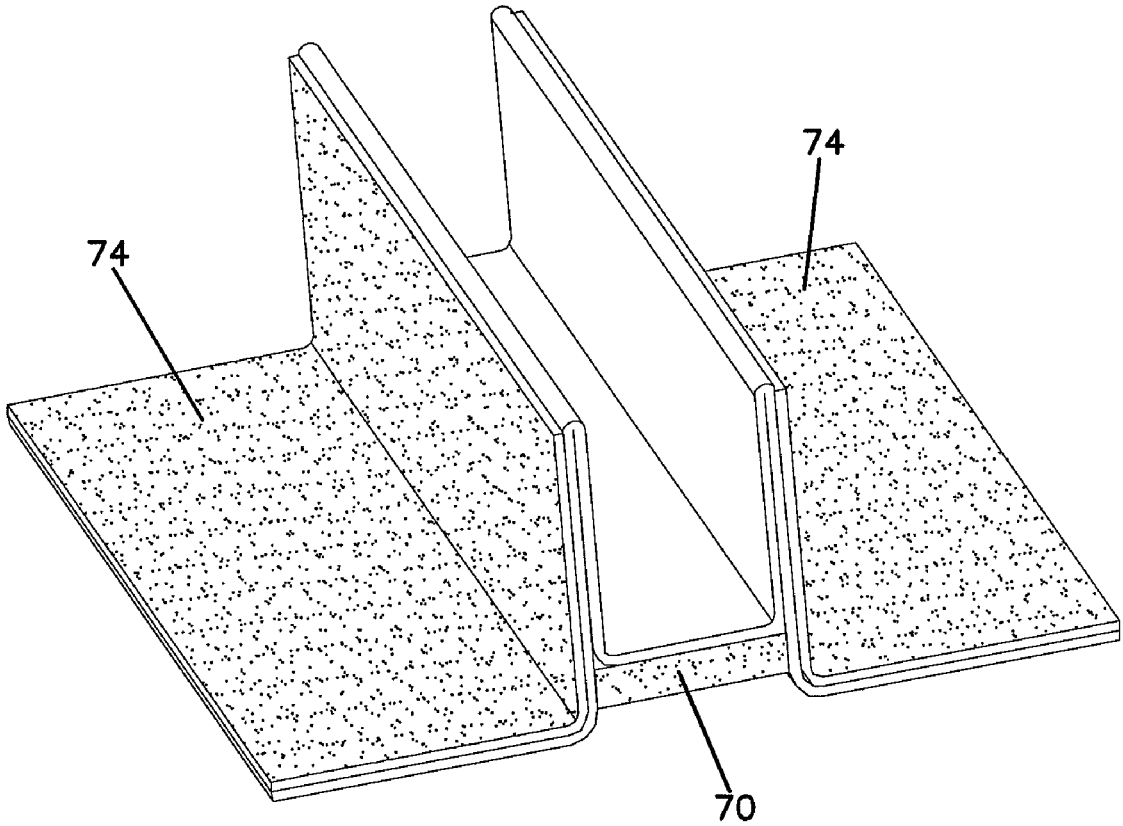
FIG. 3A is an enlarged portion of FIG. 3.

Track 30 includes a first intumescent material 70 positioned under track 30. In the example shown, material 70 is positioned in lower pocket 64. A second intumescent material 74 is positioned on a top of track 30. In the example shown, material 74 is positioned adjacent each corner 60, 62. The intumescent materials 70, 74 expand in the presence of heat and/or flame. Materials 70, 74 are in the form of layers or strips affixed to body 31 of track 30 and extend along the length of track 30. (See also FIG. 3A). The layers or strips of intumescent material can be glued, taped or affixed to track 30. Alternatively, the layers or strips can be affixed to the trim pieces for material 74, or to the partition for material 70.

Referring now to FIG. 1, fasteners, such as nails 78, mount track 30 to perimeter edge 18 of opening 16 in door material 14. Once track 30 and glass 20 are secured, trim material 82, 84 can be mounted to perimeter edge 18 of door material 14. (See also FIG. 2). Fasteners, such as nails 86, can be used to mount trim pieces 82, 84.

Figure 5:
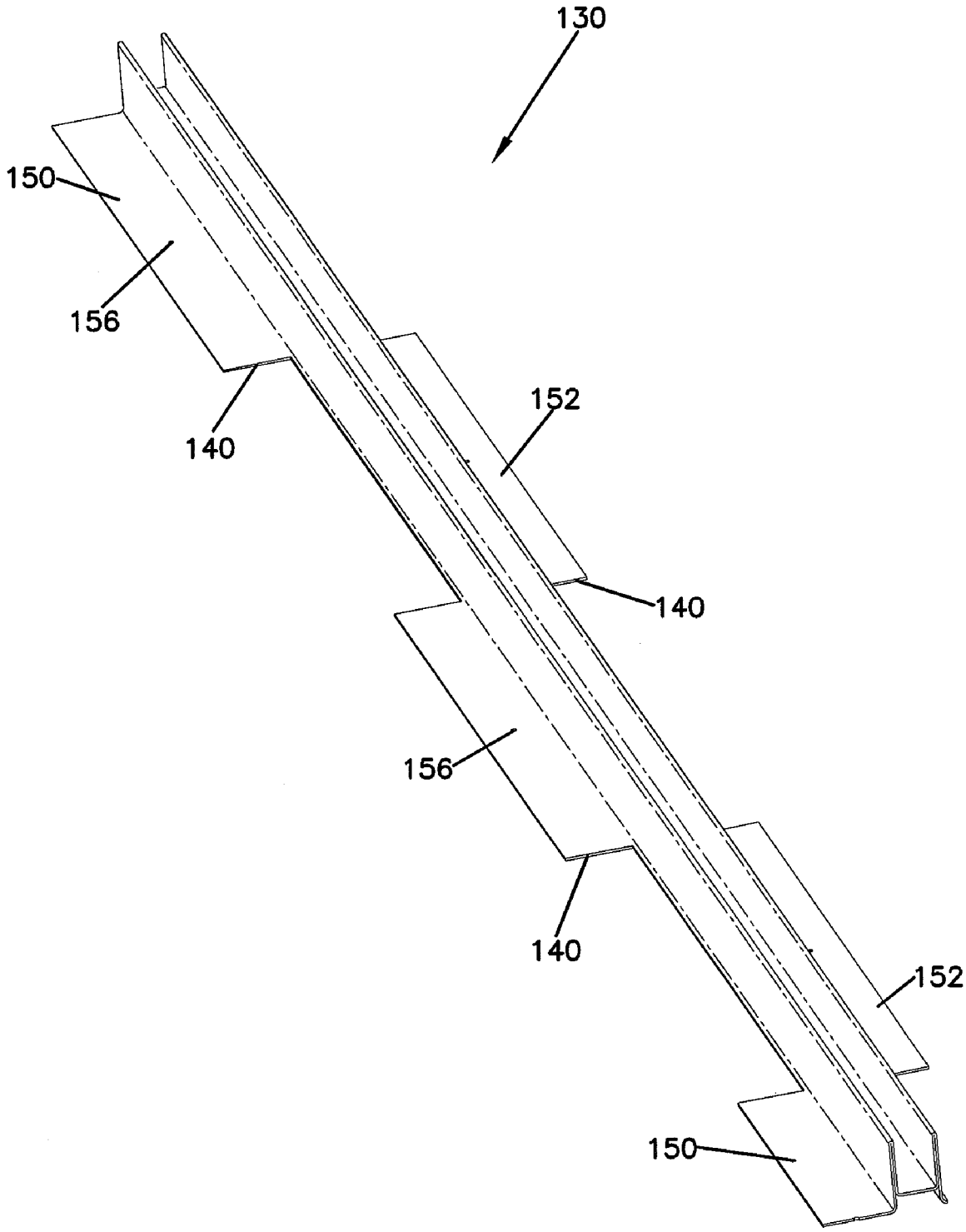
FIG. 5 is a perspective of an alternative embodiment of a segment of track including notches.

Referring now to FIG. 5, an alternative track 130 is shown including notches 140. Notches 140 can be provided so that trim fasteners 86 go directly into door material 14, rather than passing through first and second flanges 150, 152. Fastener holes 156 can be provided in flanges 150, 152 to make attachment of track 130 to door material 14 easier.

Figure 6:
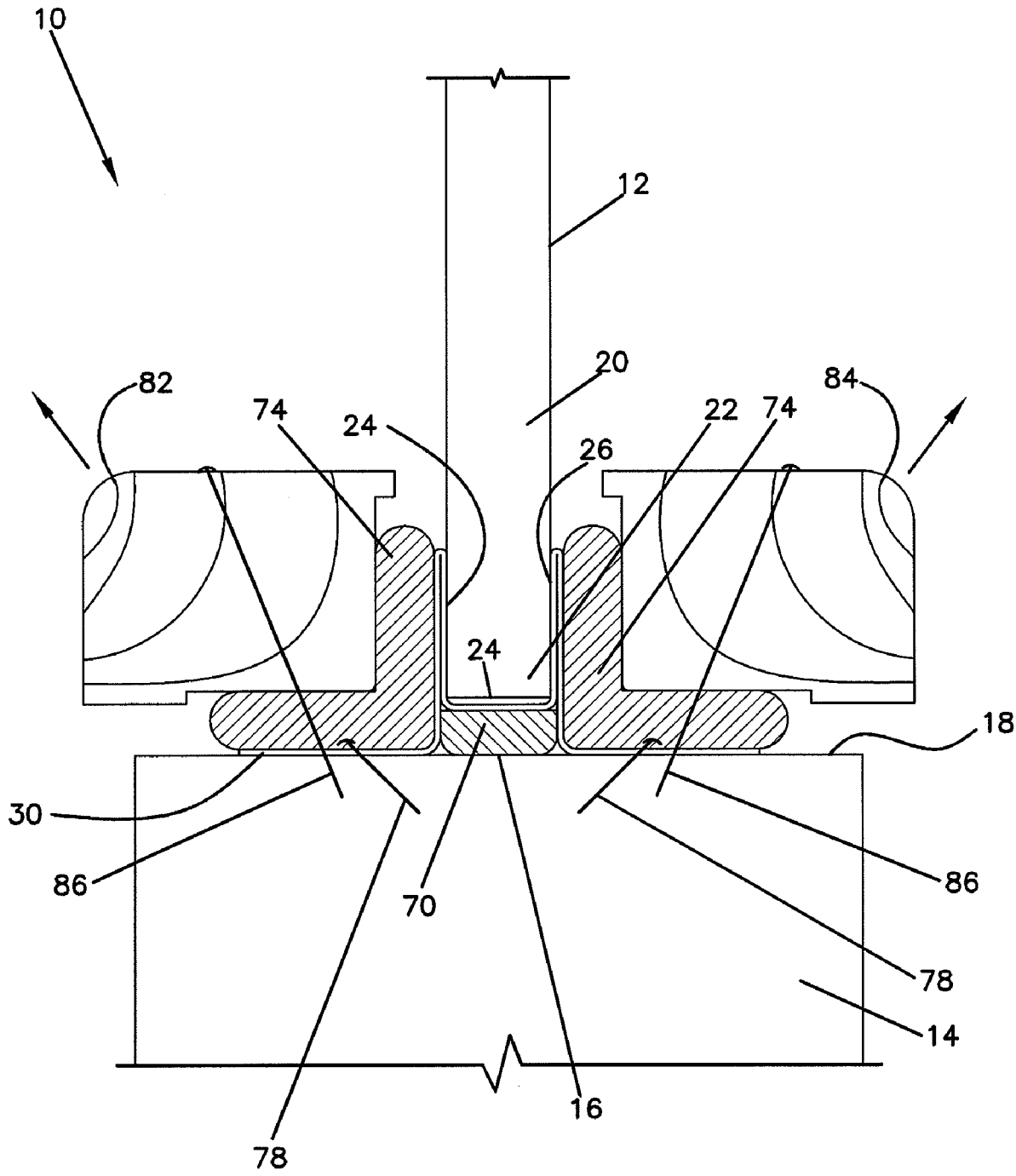
FIG. 6 shows the trim portions pushed away from the track, partition, and glass under exposure to heat and/or flame.
Figure 7:
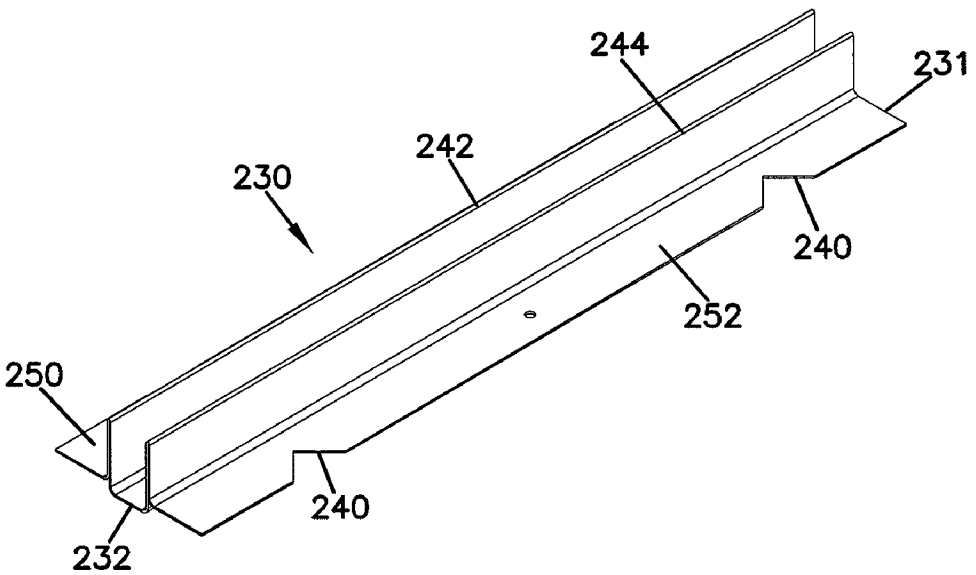
FIG. 7 is a perspective view of another alternative embodiment of a segment of track including different notches and a different profile from the embodiment of FIG. 5.
Figure 9:
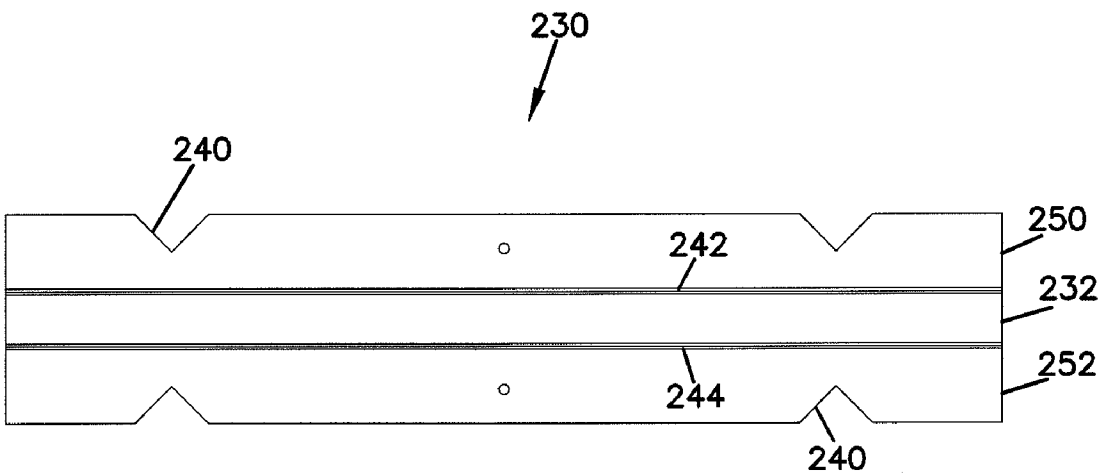
FIG. 9 is a top view of the track of FIG. 7.
Figure 8:
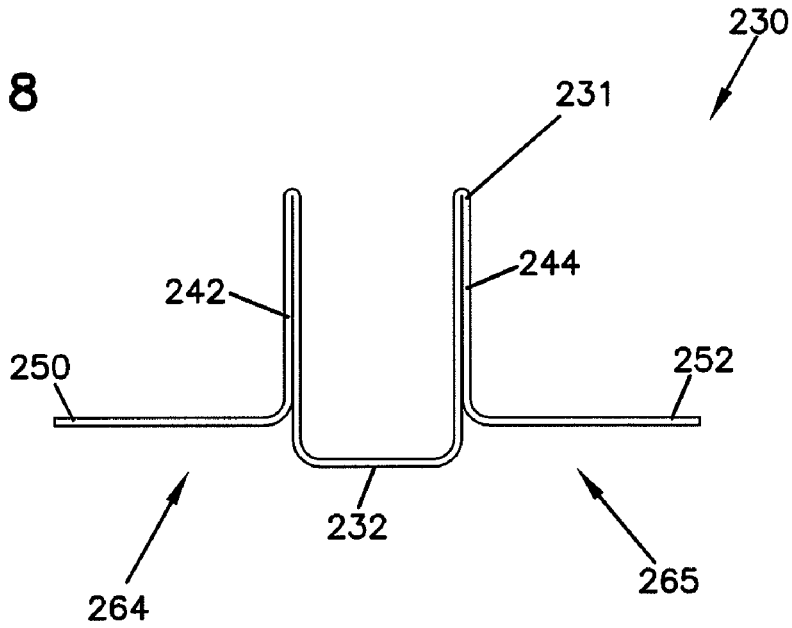
FIG. 8 is an end view of the track of FIG. 7.
Figure 10:
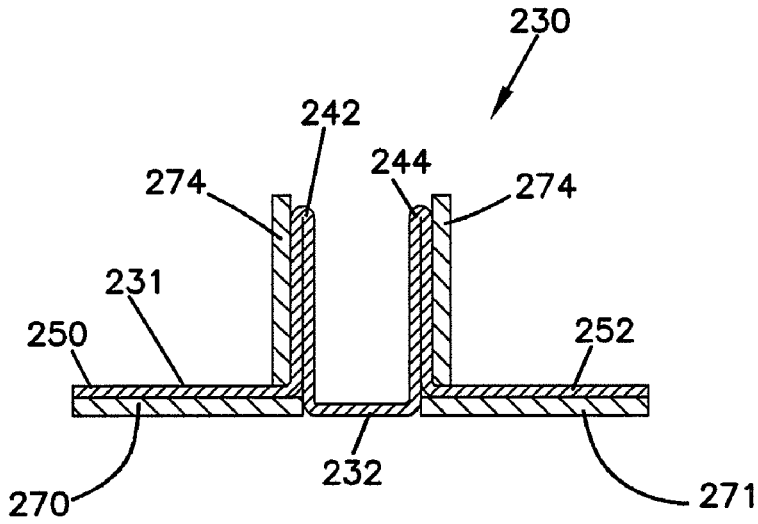
FIG. 10 is an end view of the track of FIG. 7 including the intumescent materials.

During exposure to heat and/or flame, first intumescent material 70 will expand and seal between track 30 and perimeter edge 18 of door material 14. Such seal prevents gases from passing through the window area. Second intumescent material 74 positioned adjacent to each corner 60, 62 will expand and push the pieces of trim 82, 84 away from glass 20 and door material 14, as shown in FIG. 6. Such action pushes flammable trim 82, 84 away from glass 20 and door material 14 to assist with improved fire-rating.

The intumescent materials can be the same material or different. For example, a soft puff material can be used for first intumescent material 70 (between the track 30 and the door material 14). A hard puff material can be used for second intumescent material 74 (between the track 30 and the trim 82, 84). One example for first intumescent material 70 is a soft char, graphite intumescent such as INTUMEX L or LX from Intumex GmbH, of Linz, Austria, that produces a light char with low expansion pressure. A 1/16 inch thick strip can be used. One example for second intumescent material 74 is a hard char, hydrated sodium silicate intumescent such as PALUSOL Type 104 from BASF Chemical Company, of Frantenthal, Germany. A 3/16 inch thick strip can be used.

Referring now to FIGS. 7-11, a further alternative track 230 is shown. Track 230 includes V-shaped 240 to allow trim fasteners 86 to go directly in door material 14, rather than passing through first and second flanges 250, 252.

As shown in FIGS. 7-11, track 230 includes a different end profile from tracks 30, 130 described above. Flanges 250, 252 do not define the bottom-most portion of track 230. Instead, a central channel section 232 defines the bottom-most portion of track 230. Flanges 250, 252 cooperate with central channel section 232 to define two, spaced lower pockets 264, 265. Now with reference to FIG. 10, two separate first intumescent materials 270, 271 are shown, one in each of lower pockets 264, 265.

A further difference between track 230 and tracks 30, 130 is that second intumescent material 274 is positioned only on first projecting member 242 and second projecting member 244, but not on either of first and second flanges 250, 252. The intumescent material on the upper portion of the track 30 can be positioned as desired on either or both of the projecting members defining the glass holding channel, and the outwardly extending flanges.

Tracks 30, 130, 230 operate in a similar manner in the presence of heat and/or flame. As described above, the intumescent material between track 30, 130, 230 and the door expands and seals between track 30 and the perimeter edge 18 of door material 14. The intumescent material between track 30, 130, 230 and any trim is positioned to expand and push the trim away from the glass 20 and the door material 14.

Figure 11:
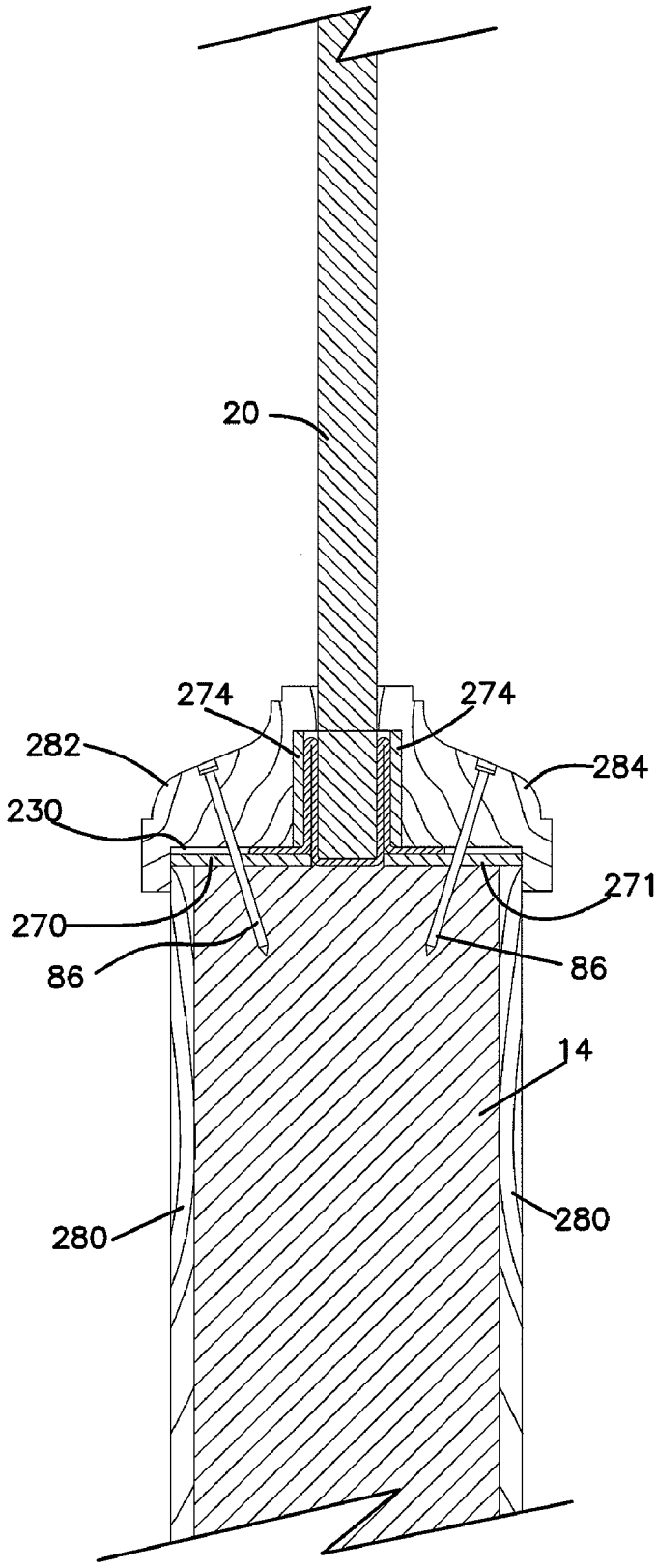
FIG. 11 is a cross-sectional view of a portion of a partition including a window, trim, and the track of FIG. 10.

Now with specific reference to FIG. 11, a cross-sectional view shows track 230 with intumescents 270, 271, 274 prior to exposure to heat and/or flame. As noted above, door material 14 may include a thin veneer 280 of flammable material, such as wood. Flammable trim 282, 284 can be provided so as to visually match veneer material 280. Then, in the presence of heat and/or flame, the various intumescents 270, 271, 274 will expand. Intumescents 274 will push trim 282, 284 away from door material 14 and glass 20 to assist with improved fire resistance of the door 10. Further, veneer material 280 may burn, but the underlining fire resistant construction of door 10 resists failure.

With the tracks 30, 130, 230 noted above, flammable trim, such as wood can be used so as to provide a more visually appealing partition or door. For example, the trim material can be matched to the wood veneer of the fire-rated partition or door.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A fire safety system, comprising:

a fire-resistant partition including an internal edge defining an aperture in the partition;

a glass pane positioned in the aperture;

a track positioned along the edge of the aperture in the partition, wherein the track includes:

a channel for capturing a periphery of the glass pane;

a flange;

a first intumescent layer; and a second intumescent layer;

a strip of trim positioned over the flange of the track, wherein the first intumescent layer is positioned between the track and the partition, and the second intumescent layer is positioned between the track and strip of trim.

2. The fire safety system of claim 1, wherein the flange of the track is a first flange, and further comprising a second flange extending in an opposite direction from the first flange, and further comprising a further strip of trim, and a third intumescent layer, wherein the third instrument layer is positioned between the track and the further strip of trim.

3. The fire safety system of claim 2, further comprising a fourth intumescent layer, wherein the fourth intumescent layer is positioned between the track and the partition, wherein the first and fourth intumescent layers are positioned in separate pockets defined by the track.

4. The fire safety system of claim 3, wherein the track includes a metal body extending in a longitudinal direction and defining an upper portion and a lower portion, the metal body including:

the channel forming a central channel section for capturing the periphery of the glass pane, the central channel section having a U-shape in cross-section and extending in a longitudinal direction, the central channel section having a base and first and second projecting sides, each of the first and second projecting sides having an inner surface and an outer surface, the inner surfaces facing one another;

the first and second flanges extending outwardly and opposite directions to each other from the central channel section, the first and second flanges each including a base surface facing in a direction opposite to a direction of extension of the projecting sides, the first and second flanges each having an opposite surface facing in an opposite direction to the first direction, the first flange and the first projecting side forming a first 90 degree corner, the second flange and the second projecting forming a second 90 degree corner.

5. The fire safety system of claim 4, wherein the metal body is made from bent sheet metal, and the first and second projecting sides are each formed from a bent over section of sheet metal.

6. The fire safety system of claim 4, wherein the first and second flanges each include a plurality of notches formed in an outside edge.

7. The fire safety system of claim 6, wherein the first and second flanges each include fastener holes.

8. The fire safety system of claim 7, wherein the second intumescent layer is positioned between the strip of trim and the first projecting side, and the third intumescent layer is positioned between the further strip of trim and the second projecting side.

9. The fire safety system of claim 4, wherein the first and second flanges each include fastener holes.

10. The fire safety system of claim 1, wherein the partition is a door.

11. The fire safety system of claim 1, wherein the flange includes a plurality of notches formed in an outside edge.

12. The fire safety system of claim 11, wherein the flange includes a plurality of fastener holes.

13. The fire safety system of claim 1, wherein the flange includes a plurality of fastener holes.

* * * * *